US005845816A

United States Patent [19]

Krane

[11] Patent Number: 5,845,816

[45] Date of Patent: Dec. 8, 1998

[54] CONTAINER FOR STORING AND DISPENSING FOURTEEN SPICES

[76] Inventor: Harold F. Krane, 1678 Farmington Cir., Wellington, Fla. 33414

[21] Appl. No.: 429,171

[22] Filed: Apr. 26, 1995

[51] Int. Cl.[6] ..... B67D 3/00

[52] U.S. Cl. ..... 222/142.9; 222/480

[58] Field of Search ..... 222/142.6–142.9, 222/185.1, 480, 485, 486, 548, 556, 565

[56] References Cited

U.S. PATENT DOCUMENTS

| | | | |
|---|---|---|---|
| 1,588,552 | 6/1926 | Sprinkle | 222/142.7 |
| 1,750,258 | 3/1930 | Brown | 222/142.9 |
| 4,288,006 | 9/1981 | Clover, Jr. | 222/142.9 |
| 4,369,901 | 1/1983 | Hidding | 222/142.7 |
| 4,583,667 | 4/1986 | Fishman et al. | 222/142.6 |

*Primary Examiner*—Andres Kashnikow
*Assistant Examiner*—Philippe Derakshani
*Attorney, Agent, or Firm*—Michael J. Colitz, Jr.

[57] ABSTRACT

A cylindrical container vertically multi-compartmented with circumferentially equally sectioned vertical partitions that are further divided along a horizontal plane providing fourteen compartments to store particulate spices. The first and second ends of the product chambers are closured with a double tier cover assembly sealing both ends with lids that are molded to a configuration that restrains spice cross-contamination. The recessed snap rim of the sealing lid receives a rotatable manually regulable dispensing disc, that is motivated by finger grips, to rotate in either direction, to position ports for replenishing and dispensing product to register over the desired spice compartment. This disc cover embodies dispensing ports comprising multiorifices perforated to dispense spices. Lock flaps, operational on living hinges, formulate closures on the top side of the dispensing disc when the container is not in use. The product chambers are identified with printed acetate stickers supplied, with unit and applied by the user.

5 Claims, 3 Drawing Sheets

CONTAINER FOR STORING AND DISPENSING FOURTEEN SPICES

REFERENCES CITED

U.S. Pat. No. 4,288,006 September 1981 Clover 222/42 U.S. Pat. No. 3,737,075 June 1973 Atchley 222/142.9 U.S. Pat. No. 3,878,971 April 1975 Freedman 222/142.6 U.S. Pat. No. 4,488,667 December 1984 Swett et al 222/485 U.S. Pat. No. 4,191,312 March 1980 Shemtov 222/143.9

DESCRIPTION OF THE PRIOR AND EXISTING ART

The state of the art to which this invention relates, for background purposes, as indicative of multicompartmented spice dispensers, are disclosed in U.S. Pat. No. 4,288,006, No. 4,191,312, and No. 3,878,971. These inventions represent the most advanced design for selectively dispensing powdered spices with the design application of the common concept of employing a cylindrical container to house multicompartments that are triangularity formed by an elongated axial hub and circumferentially equidistant dividers to storage the selectively chosen spices. The above referenced inventions employ the common feature of a rotatable cover retentively mounted on top of the container.

Each of the above inventions employs a perforate as the only means of dispensing the spices from a selected chamber. This is a serious design limitation since there are many spices, due to their hygroscopic characteristics, tend to cake thus clogging the perforate. Other popular ground leaf spices will not eject from the aperture of a perforate.

Another crucial design feature, that has prevented the market-ability of the aforementioned inventions, has been overlooked. The inherent operational problem that negates the patented functional designs, is their failure to address the problem of cross-contamination of one compartment's spice contents into that of another when the rotatable dispensing cover is rotated to select another spice. Exhaustive testing of prototype spice dispensers, based on the above invention designs, resulted in cross-contamination of one spice into a neighboring chamber, when the dispenser was up-ended to the shake mode and then righted with a residue of the shaken spice on the bottom surface of the rotatable cover, wherein further rotation of the cover to an adjacent spice compartment resulted in considerable carry-over, which proved to be objectionable to marketing professionals. Although close tolerance exists between the lower surface of the rotatable cover and the top surfaces of the compartment partitions, the hygroscopic characteristic of spices to absorb moisture, causes their adherence to the bottom surface of the cover when upended for the shake mode. Shake mode meaning, when the user positions the container to extract spice product.

SUMMARY OF THE INVENTION

Although this invention incorporates some of the similar principals of design found in the above inventions, it also consists of several computerized design methodology that advances the art to an acceptable state for consumer consumption.

The basic design objectives are that of providing a convenient receptacle to dispense fourteen different particulate spices;providing a dispensing cover configuration that individually and selectively dispenses a plurality of particulate; providing a means of storing fourteen spices that the user can select marked with indicia; a further design objective of the invention is to provide a means to sanitarily maintain the unit and employ simplified design features that promote versatility; effortless operation and convenience of disassembly for cleaning; the availability of fourteen separate spices provide recipe cooks and bakers with a wide variety of spice selection. The final objective of this invention addresses the problem of cross-contamination with the introduction of specially designed container lids that provide nearly total retention of spices in their separate compartments when the rotatational dispensing disc is activated following the container being up-ended for the shake mode.

In essence, the new invention contemplates the development of an improved container for, storing and selectively dispensing several spice particulate and extending the applications of the device to several other culinary applications that are not available in the prior art.

The new invention achieves all of the design objectives with simplified design and other features that promote versatility, effortless operation, ease of assembly and disassembly, and recipe cooking and baking is convenienced with a container having fourteen compartments storaging different ground spices, herbs and flavoring products.

The improved container device for storaging and selectively dispensing fourteen particulate spices comprised of a body member formed from a cylindrical configuration of a transverse cross section which is preferably circular in shape and incorporate a plurality of circumferentially equally sectioned vertical partitions that connect from an internal elongated axial hub member to the interior surface of the housing. The dividers define an open-ended triangular compartment for storing the usable spices. These vertical compartments are further divided along a horizontal planum with a divider vertically producing an upper level of 60% by volume with a first end and lower 40% level with 2nd end. A cover assembly is rotatably mounted on top of the first and second ends of the body member, whereby the lower lid of the assembly is configured and molded to prevent cross-contamination of spices, when it is permanently affixed to both ends of the container.

The polypropyline plastic disc that snaps into the recess of the stationary lid's snap rim, is designed to rotate 360° either clockwise or counterclockwise. The stationary lid is molded with circular openings that are located over each spice storage chamber and the rotating disc is molded to connect to two individual flaps that will open and close on 'living hinges'. Each flap is designed to be finger-raised and snapped back into closed position whereby one flap, when raised, exposes a circular fill-opening and the other flap exposes a shake opening provided with a plurality of orifices, when the disc is rotated and positioned over the desired spice chamber. When both flaps are snapped back into the rotating disc, the unit is closed for the storage mode. The spice dispenser is furnished with a plastic funnel that has a discharge spout that accommodates the fill-opening in the rotating disc and the stationary lid. It is also complete with a sheet of clear acetate printed stickers that contain names of the most popular spices. These stickers are peeled off the sheet and applied to the outer surface of the container that identifies the chamber's spice contents.

The salient features have been outlined as introductory to the detailed description of the invention that will subsequently follow and thus provide greater insight into understanding the contribution the device will make to the art. The above abstract will further enable the patent examiners, design engineers, the general public and manufacturers in the art to peruse the technical aspects of this patent submission to determine the subject matter being disclosed.

This new invention has been designed to overcome the disadvantages and limitations of the prior art and effectually improving upon the present art; the dispenser consists of three (3) simple parts which will substantially reduce mold, material and assembly costs; the design simplicity further enables the manufacturer to utilize handicapped personnel for assembly of parts, packaging, crating and shipping; the dimensions of the container permit a small child, an arthritic person or any aged individual to handle the dispenser safely and comfortably to manipulate the two top cover assemblies which will activate product fill and dispensing; bakers and gourmet cooks have available a single container that stores fourteen different spices and flavorings to add to their recipes; the 'Spice Carousel' is easily disassembled by merely removing the top and bottom discs and placing the components in the dishwasher; the entire unit has been designed for mass production, utilizing food gradeable materials, at a low consumer price; the container design is further provided with stick-on labels to identify the contents in each compartment; attractive appearance of this product enhances any formal setting.

DESCRIPTION OF THE DRAWINGS

The drawings attached will enable the examiners, reviewing this invention, to expeditiously arrive at a judgement relating to this spice dispenser. The representations graphically details the construction and the operation of the product.

The drawings convey the following descriptive information.

DESCRIPTION OF THE PREFERRED EMBODIMENTS

Figure 1:
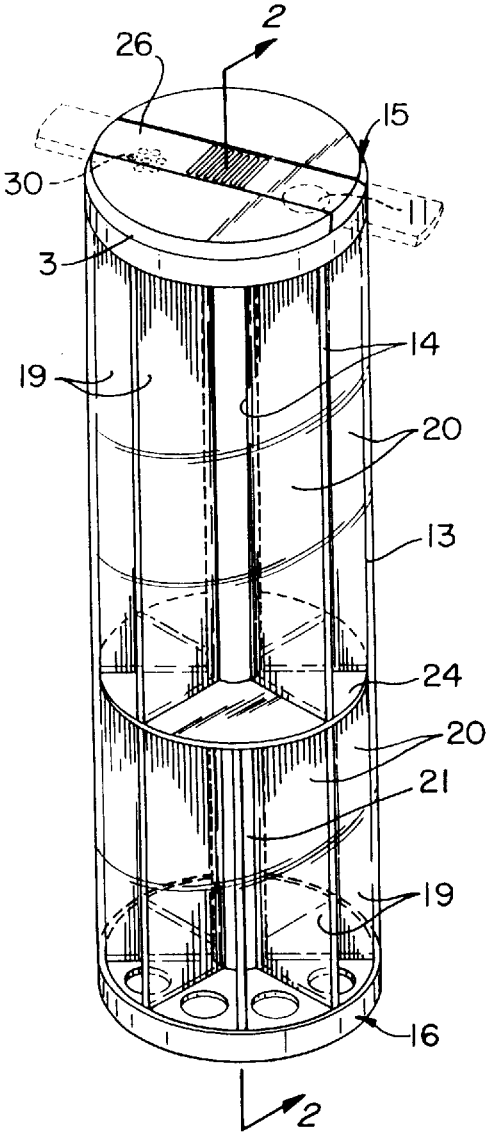
FIG. 1. The present invention is perspectively represented as a total assembly, providing a detailed relationship of components comprising the dispenser.

Reference is made to the annexed drawings for the purpose of rendering an intelligible description and explanation of the new invention. FIG. 1 indicates a perspective view in isometric section of the completely assembled invention which constitutes top and bottom cover assemblies 15 and 16 that are applied to the tops of the container 13 for purposes of filling and discharging particulate. The container 13 with its elongated cylindrical exterior, serves the primary purpose of storaging fourteen different spices. The container 13 achieves its ability to store this quantity of spices by virtue of its internal construction, which consists of a horizontal plastic partition 24 that divides the container 13 60% upper level, line 7—7 and 40% lower level, line 6—6, by volume. Per 14 vertical partitions 19 that form chambers 20 and 21 by seams with the inner wall of the container 13, the grooves in the center column 22, the undersides of the stationary lid 3 and the horizontal divider 24. The horizontal partition 24 and the closed cover assemblies 15 and 16 at each end of the container 13 allows the user the ability to up-end the entire unit 13 to gain access to all stored spices. The seams that form the fourteen compartments must be sealed water-tight by a properly designed mold to prevent cross-contamination of spices. The container 13, all partitions 19 and the horizontal divider 24 could be manufactured from transparent, translucent or opaque materials such as, Lucite ABS acrylicnitril butadine styrene plastic or any other similar plastic material that will result in economical and efficient production. All materials that will comprise the manufacturing process shall be within the scope of this new invention.

Figure 2:
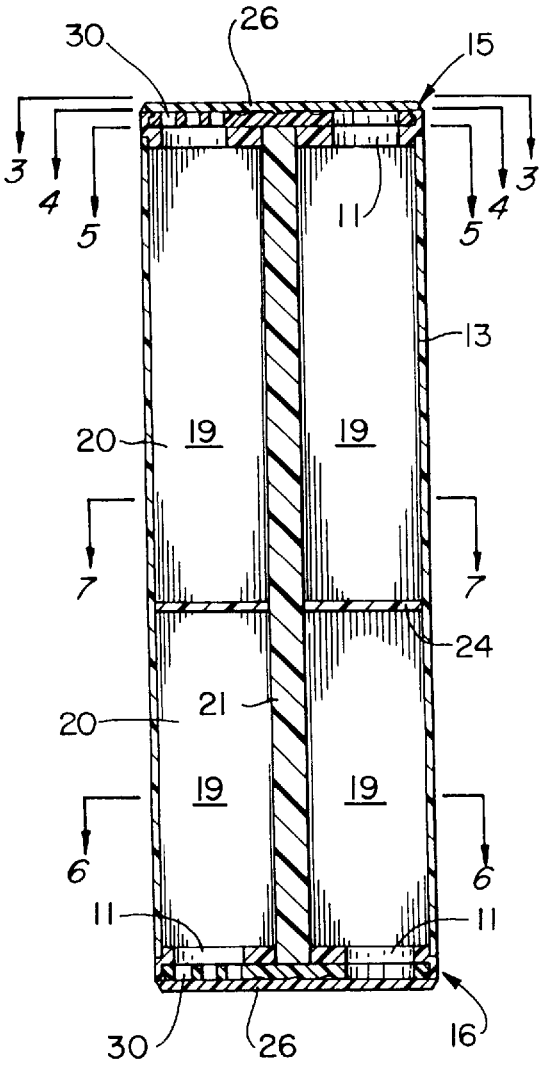
FIG. 2. Provides a cross-sectional view, line 2—2, of the upper and lower levels which result from the horizontally partitioned compartments. The flap for filling spices into the partitioned sections and the flap for discharging the product from the compartments are indicated in their respective open positions. The upper and lower partitioning are shown connecting the outer shell and cent post.

FIG. 1, FIG. 2 provide perspective and cross-sectional views of the total unit which also indicate the upper level 7 with six partitioned 19 compartments 20 and the lower level 6 with eight partitioned 19 compartments 21 and the relationship of this entire arrangement to the upper level cover assembly and the lower level cover assembly 16. The fourteen compartments 20 and 21 thus molded, as sealed chambers, will only have an opening 11 at the top of each chamber 20 and 21, where they are sealed and connected to the underside of the lower stationary lid 3 of the cover assembly 15 and 16. The opening 11 serves to provide a means to fill and discharge spices from each compartment 20 and 21.

Figure 5:
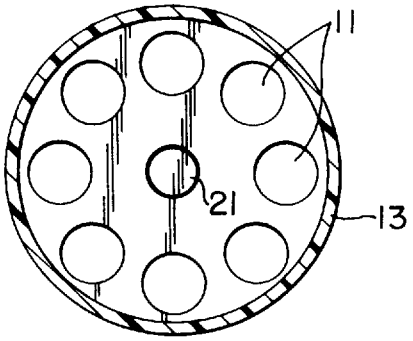
FIG. 5. Representation of the stationary lid molded with six and eight circular openings located over spice chambers as indicated in FIGS. 6, line 6—6 and FIGS. 7, line 7—7.
Figure 6:
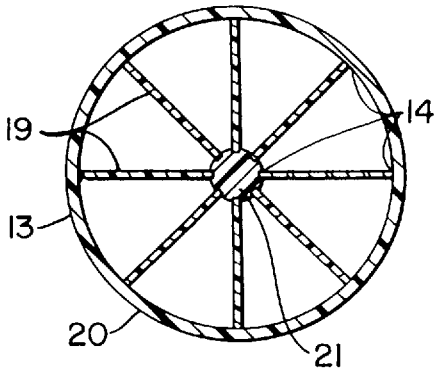
Figure 7:
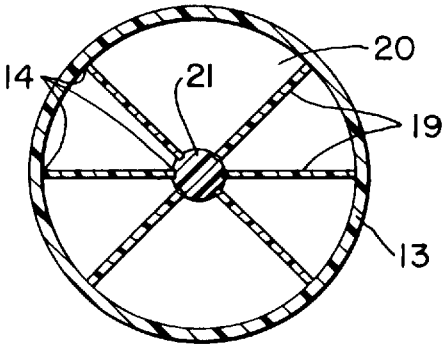

Cover assemblies 15 and 16 each consists of a lower lid 3, detailed in FIG. 5 which are molded with equally and circumferentially circular apertures 11 that provides substantial cover over all chambers 20 and 21 to prevent spill-over of residue particulate when the, disc dispenser 2 is rotated over the stationary lid 3 for product filling and discharging through openings 11. The stationary lid 3 is molded with an internal snap ring on rim 4 to receive the upper disc 2, thereby allowing for complete rototatability within the rim 4 .

Figure 3:
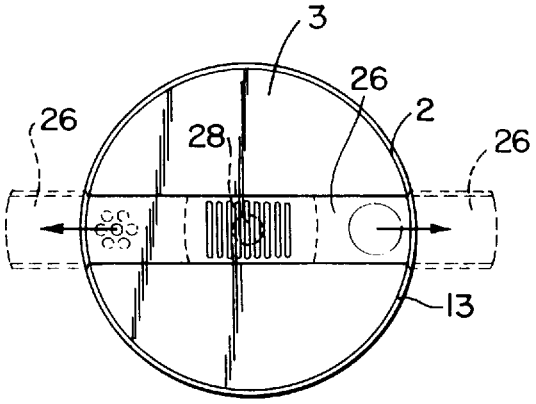
FIG. 3. The upper plane of the rotating disc is displayed complete with finger raised flaps and finger grips for rotation FIG. 4. The lower plane of the rotating disc reveals the circular opening for filling spices and a perforate for shaking spices from the container. The upper and lower planums are molded as a single unit.
Figure 4:
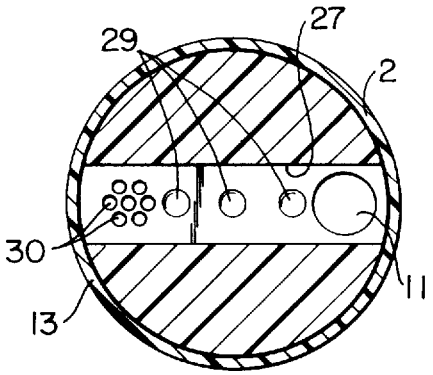

FIG. 3 and FIG. 4 detail plan view sections of disc 2 for cover assemblies 15 and 16, which are replicated and can be interchanged for either end of the container 13. Due to the unique design and operation of disc 2, it must be manufactured with polypropalene plastic, or equivalent. FIG. 3 displays the topside of disc 2 indicating two separate flap 26 and flap 27 that are an integral part of disc 2 by virtue of living hinges 6 that permit finger raising and snapping back into their respective receptacles 33. Flap 26 is molded with underside snap pins, 26*a* to lock into matching perforate 30 on the base surface of disc 2 and flap 27 is a solid cover providing closure for a circular discharge 32 also located on the base surface of disc 2. FIGS. 3 and FIGS. 4 are separate planum sections of disc 2, which is singularity molded as one assembly.

Figure 8:
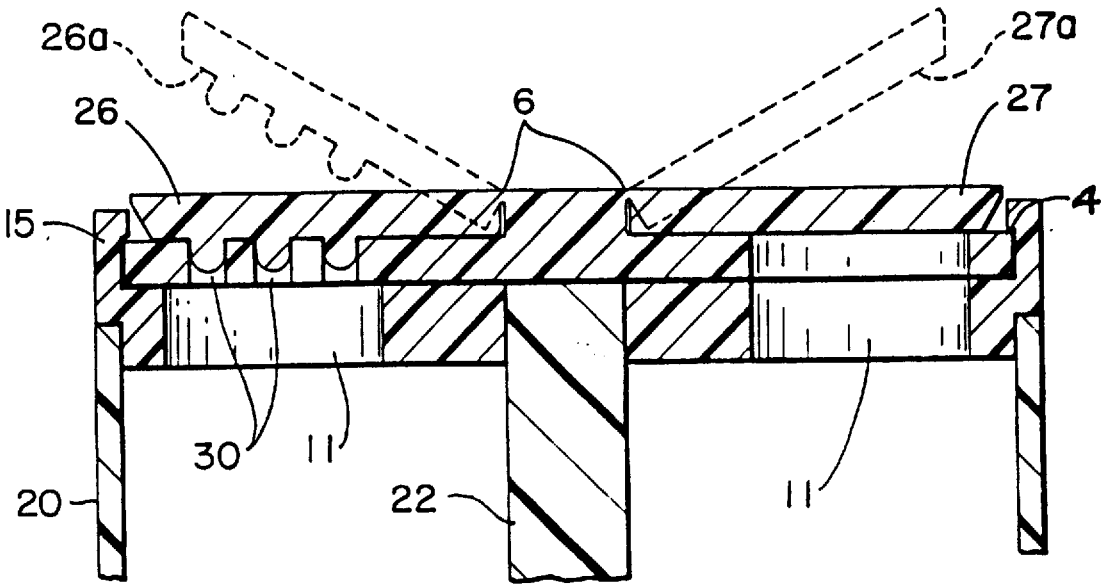
FIG. 8. Graphically describes line 3—3, lines 4—4 and line 5—5, which shows the relationship of the rotating disc snapping into the rim of the stationary lid. Flaps for filling and shaking are shown in the closed and open positions.

Should a user desire to fill a particular compartment 20 and 21 with particulate, the upper level disc 2 is rotated, using finger grips 5 with applied horizontal pressure, to position the flap 27 over the desired chamber 20 and 21. Flap 27 is raised with finger lift, thus exposing aperture 32 on the base surface of disc 2, which will be registered exactly over aperture 11 on stationary Lid 3 thus exposing that compartment 20 and 21 for filling of product; discharging the desired spice from a selected chamber 20 and 21, requires the operator to finger-raise flap 26 from the perforated orifices 30 on the base surface of disc 2, and rotate disc 2 over the chosen chamber 20, which exposes the circular opening 11 on lid 3. When the entire container 13 is upended, it is in the shake mode for that selected spice. FIG. 8 illustrates the assembly and operation of the complete Cover assemblies 15 and 16. FIG. 5 indicates the eight circular apertures 11 on the stationary lid 3, that are centered over each chamber 21 for the lower level 6. A similar lid 3 with six circular openings that are centered over each chamber 22, is applied and sealed over the upper end of Container 13.

A sheet of forty stickers is provided with each 'Spice Carousel'; thirty peel-off stickers have names of different spices and ten stickers are blanks allowing the user to print spice names not provided. The stickers are clear acetate and are easily peeled and applied to each chamber on the outside wall of the container 13.

As to the manner of usage and operation of the present invention, the same should be apparent from the above description. As such, no further discussion thereof will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A device for storing and dispensing fourteen dispensing spices comprising:

a. an elongated, cylindrical container fabricated of plastic and defining an interior and having internal dimensions to compartmentalize and store fourteen spices;

b. the container having an open first end and an open second end arranged with a horizontal partition that divides the interior into an upper level constituting about 40 percent of the volume of the container and a lower level consisting about 60 percent of the volume of the container;

c. the container having an upper cover over the first end and a lower cover over the second end, the container being molded with a solid plastic rod located in the center axis of the housing, thus creating a center column with a spline to accept and support the horizontal partition to form an upper interior at the upper level and a lower interior at the lower level;

d. the container having six equally spaced vertical partitions in the upper interior and eight equally spaced vertical partitions in the lower interior to form six chambers on the upper interior and eight chambers on the lower interior, each chamber formed by the vertical partitions extending radially between the column and the container and extending longitudinally between the horizontal partition and a cover; and e. a circular stationary rimmed lid frictionally fit into the inner surface of the chamber at each end.

2. The device of claim 1 whereby the center column is formed with splines to receive and support the vertical partitions, the horizontal partition and the rimmed lid.

3. The device of claim 1 wherein the lid is molded with circular openings that are dimensioned to locate over each chamber for filling and dispensing spices with respect to a chamber, the lid being molded with a center circular opening to fit over the center column whereby the center column protrudes beyond the partitions to receive the rimmed lid, and the lid being molded so as to be located within the container and further including a dispensing disc with a periphery rotatably received within the lid at each end.

4. The device of claim 3 whereby each dispensing disc is formed with apertures and, at last one of the apertures including perforations, and is molded of plastic material and is configured as a single unit having two flaps molded with a living hinge on the inside and a finger grip on the outside, whereby both said flaps constitute sealing covers with sealing means to provide a sealing closure, the underside of sealing closure, the underside of at least one flap being molded with snap points to coincide and lock into the perforations in an associated disc; the underside of the flaps being molded with a snap circular rim that will lock into the fill opening in the disc, the entire disc being rotatable when snapped into the rim of the stationary lid whereby applying finger pressure to the finger grips allows the opening of a chamber.

5. The device of claim 4 wherein the two flaps can be lifted from the associated disc, thereby exposing the opening over the associated chamber for purposes of filling such associated chamber with a spice and to a spice by shaking.

* * * * *